US009502768B2

(12) United States Patent
Huang

(10) Patent No.: US 9,502,768 B2
(45) Date of Patent: Nov. 22, 2016

(54) ANTENNA MODULE WITH PROXIMITY SENSING FUNCTION

(71) Applicant: PEGATRON CORPORATION, Taipei (TW)

(72) Inventor: Chin-Ting Huang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 161 days.

(21) Appl. No.: 14/271,109

(22) Filed: May 6, 2014

(65) Prior Publication Data

US 2014/0333494 A1 Nov. 13, 2014

(30) Foreign Application Priority Data

May 7, 2013 (TW) ..... 102208397 U

(51) Int. Cl.

*H01Q 1/24* (2006.01)
*H01Q 5/00* (2015.01)

(Continued)

(52) U.S. Cl.

CPC ..... *H01Q 5/328* (2015.01); *H01Q 1/002* (2013.01); *H01Q 1/243* (2013.01); *H01Q 1/44* (2013.01); *H01Q 5/20* (2015.01); *H01Q 5/378* (2015.01); *H01Q 9/42* (2013.01)

(58) Field of Classification Search

CPC ..... H01Q 1/241; H01Q 1/242; H01Q 1/243; H01Q 1/245; H01Q 1/44; H01Q 1/50; H01Q 5/307; H01Q 5/314; H01Q 5/328; H01Q 5/364; H01Q 5/371; H01Q 5/378; H01Q 5/385; H01Q 5/392; H01Q 1/2258; H01Q 1/2266; H01Q 1/27; H01Q 1/273; H01Q 5/20; H01Q 5/22; H01Q 5/50; H01Q 9/30; H01Q 9/42; H01Q 19/021; H01Q 23/00

USPC ..... 343/702, 720

See application file for complete search history.

(56) References Cited

U.S. PATENT DOCUMENTS 5,300,897 A * 4/1994 Shiga ..... H02H 9/045 330/207 P
8,432,322 B2 * 4/2013 Amm ..... H01Q 1/243 324/658

(Continued)

FOREIGN PATENT DOCUMENTS

TW 201240206 10/2012
TW 201307857 2/2013

OTHER PUBLICATIONS

Yi-Lun Jan, "Investigation of ESD Protection Devices in High-speed Digital System", eThesys, 2005 , 89 pages.

*Primary Examiner* — Sue A Purvis
*Assistant Examiner* — Patrick Holecek
(74) *Attorney, Agent, or Firm* — Muncy, Geissler, Olds & Lowe, P.C.

(57) ABSTRACT

An antenna module with proximity sensing function is provided for being disposed inside an electronic device and comprises a ground plane, an antenna, a sensing element, an electrostatic protection element, a high-frequency blocking element and a capacitive proximity sensor. The antenna is coupled to the ground plane. The sensing element is connected to the capacitive proximity sensor through the high-frequency blocking element and produces a capacitance signal when sensing the approach of an object for accordingly reducing the output power of the antenna module. The electrostatic protection element is coupled between the sensing element and the ground plane, exhibits low/high impedance, respectively, at high/low frequency and further changes to an extremely low impedance to provide a conducting path to quickly lead a static high voltage to the ground plane for keeping the electronic device operating normally when the electronic device encounters the problem of the electrostatic discharge.

9 Claims, 9 Drawing Sheets

(51) Int. Cl.

| | |
|---|---|
| ***H01Q 5/328*** | (2015.01) |
| ***H01Q 5/20*** | (2015.01) |
| ***H01Q 1/00*** | (2006.01) |
| ***H01Q 1/44*** | (2006.01) |
| ***H01Q 9/42*** | (2006.01) |
| ***H01Q 5/378*** | (2015.01) |

(56) References Cited

U.S. PATENT DOCUMENTS 8,466,839 B2 * 6/2013 Schlub ..... H01Q 1/243 343/702
8,467,840 B2 * 6/2013 Lin ..... H01Q 1/245 455/550.1
8,577,289 B2 * 11/2013 Schlub ..... G01B 7/023 343/702
8,649,833 B1 * 2/2014 Lee ..... H01Q 5/335 455/575.7
8,686,297 B2 * 4/2014 Shiu ..... H05K 1/028 174/250
8,723,749 B2 * 5/2014 Lin ..... H01Q 5/328 343/772
8,971,826 B2 * 3/2015 Abdul-Gaffoor .... H04B 1/0458 455/77
2010/0238080 A1 * 9/2010 Lindberg ..... H01Q 1/243 343/748
2012/0329524 A1 * 12/2012 Kent ..... G06F 3/044 455/566
2013/0241796 A1 * 9/2013 Nagumo ..... H01Q 1/243 343/861

* cited by examiner

ANTENNA MODULE WITH PROXIMITY SENSING FUNCTION

CROSS-REFERENCE TO RELATED APPLICATIONS

This Non-provisional application claims priority under 35 U.S.C. §119(a) on Patent Application No(s). 102208397 filed on May 7, 2013, the entire contents of which are hereby incorporated by reference.

BACKGROUND OF THE INVENTION

Field of the Invention

This invention relates to an antenna module with proximity sensing function for a communications electronic device and, more particularly, to an antenna module with proximity sensing function capable of preventing electrostatic discharge shock.

Description of the Related Art

A portable electronic device is favorable for wide users recently due to numerous advantages such as small size, convenient operation and powerful function. The most popular portable electronic device is smart phone and tablet PC, in which the tablet PC first appeared from iPad by Apple Inc. in the US and followed by more technology industries involved more resource to develop similar products and the accessories.

Due to such the electronic devices has the function of wireless communications, there is an antenna disposed therein to receive and transmit wireless signals. As shown in FIG. 8, there is an antenna module 81 disposed at a side of a tablet PC 80. If the human body approaches to the antenna module 81 when the antenna module 81 is processing a wireless reception and transmission, the human body may have an issue of absorbing radiation electromagnetic wave thus to affect the health. For this reason, rules established by Federal Communications Commission (FCC) in US and Conformite European (CE) in European Union both restrict that the Specific Absorption Rate (SAR) for the human body needs to be in a reasonable range. SAR is necessary to be lower than 1.6 W/Kg according to FCC rules and is necessary to be lower than 2.0 W/Kg according to CE rules.

In order to satisfy the abovementioned rules of SAR, the antenna module 81 of such the electronic device is designed to have a power inhibit mechanism for automatically modulating the output power when the human body approaches the antenna module 81. The power inhibit mechanism is mainly to dispose a sensor pad inside the antenna module 81 for sensing whether the human body approaches or not. As the human body is getting closer to the sensor pad, such as the user exactly hold the side provided with the antenna module 81, there will be a capacitance signal inducted in a gap between the human body and the sensor pad. The capacitance will increase as the gap become smaller and the capacitance signal will be provided to a central processing unit (CPU) to allow the CPU to output a controlling instruction according to the capacitance signal for decreasing the power of a RF amplifier of the antenna module 81 and further achieving the purpose of decreasing SAR. However, the antenna module 81 is mostly disposed at the edge of the electronic device. Such the position will be easily contacted with human body thus to be affected by electrostatic discharge (ESD) shock from the human body and thereby cause the instability of the electronic device or the damages of the components.

Please refer to FIG. 9, Taiwan patent publication No. 201240206 titled "antenna with integrated proximity sensor for proximity-based radio-frequency power control" uses an antenna structure 200 to receive and transmit a RF antenna signal and sense whether the human body approaches or not. The antenna structure 200 is connected to a ground plane by capacitors CFP, CFG, respectively. However, the disclosed structure of this invention cannot achieve the effect of preventing electrostatic discharge shock so that the electronic device may be affected to cause damages when facing an abnormal instantaneous high voltage.

Please refer to FIG. 10, US patent publication No. 2011/0012793 discloses that a sensor board 66 is connected to a capacitor 124 in parallel, and the sensor board 66 can detect whether the human body approaches or not for decreasing SAR. However, such the structure also cannot achieve the effect of preventing electrostatic discharge shock.

BRIEF SUMMARY OF THE INVENTION

Although the antenna module of the current electronic device can sense whether the human body approaches the electronic device to reduce SAR, the shock of an abnormal instantaneous high voltage resulted from ESD still cannot be efficiently avoided. Therefore, Applicant develops the antenna with proximity sensing function of the present invention and wishes to achieve the following purposes:

A main purpose of the present invention is to provide an antenna capable of processing wireless reception and transmission of data, automatically sensing the approach of the human body for reducing SAR and further overcoming the shock resulted from ESD for ensuring the electronic device operating normally.

To achieve the abovementioned purpose, an antenna module with proximity sensing function of the present invention is provided for being disposed inside an electronic device and comprises:

a ground plane;

an antenna connected to the ground plane through a signal feed-in element for wireless transmission and reception of data;

at least a sensing element having a gap kept to the antenna and connected to a capacitive proximity sensor through a high-frequency blocking element, wherein the sensing element produces a capacitance signal to be transmitted to the capacitive proximity sensor through the high-frequency blocking element when sensing the approach of an object; and at least an electrostatic protection element connected between the sensing element and the ground plane, wherein the electrostatic protection element exhibits low impedance at high frequency, exhibits high impedance at low frequency and exhibits a conducting state when facing an abnormal instantaneous high voltage to allow the instantaneous high voltage to be transmitted to the ground plane.

By the abovementioned structure, when the sensing element is approached by the human body thus to produce a capacitance signal, because the operation is performed in a lower frequency, the electrostatic protection element itself is in a high impedance state and approximates an open circuit so that an isolation effect is effective to prevent the capacitance signal from being led to the ground plane and the capacitance signal can be successfully transmitted to the capacitive proximity sensor for effectively controlling SAR.

When the operation is performed at high frequency, the electrostatic protection element exhibits low impedance and approximates a short circuit and the high-frequency blocking element exhibits high impedance state and approximates an open circuit for preventing the high-frequency signal from entering into the capacitive proximity sensor 15.

The electrostatic protection element changes to extremely low impedance when facing an abnormal instantaneous voltage and instantaneous current for provide a conducting path to the ground plane so that the instantaneous current can quickly pass through the electrostatic protection element to be led to the ground to achieve the protection effect of preventing ESD shock.

Another purpose of the present invention is to provide an antenna module with proximity sensing function by using single structure to achieve the effect of an antenna and a sensing element. And also, it can process wireless reception and transmission of data, automatically sense the approach of the human body for reducing SAR and overcome the shock resulted from electrostatic discharge.

To achieve the abovementioned purpose, the antenna module with proximity sensing function of the present invention comprises:

a ground plane;

a coupling element connected to the ground plane through a matching circuit and a signal feed-in element;

a high-frequency blocking element connected between the coupling element and a capacitive proximity sensor;

at least an electrostatic protection element connected between the coupling element and the ground plane, wherein the electrostatic protection element exhibits low impedance at high frequency, exhibits high impedance at low frequency and exhibits a conducting state when facing an abnormal instantaneous high voltage to allow the instantaneous high voltage to be transmitted to the ground plane; and wherein the coupling element is used as an antenna for receiving and transmitting data in high-frequency operation and as a sensing element in low-frequency operation for producing a capacitance signal when sensing the approach of an object.

DETAILED DESCRIPTION OF THE INVENTION

Figure 1:
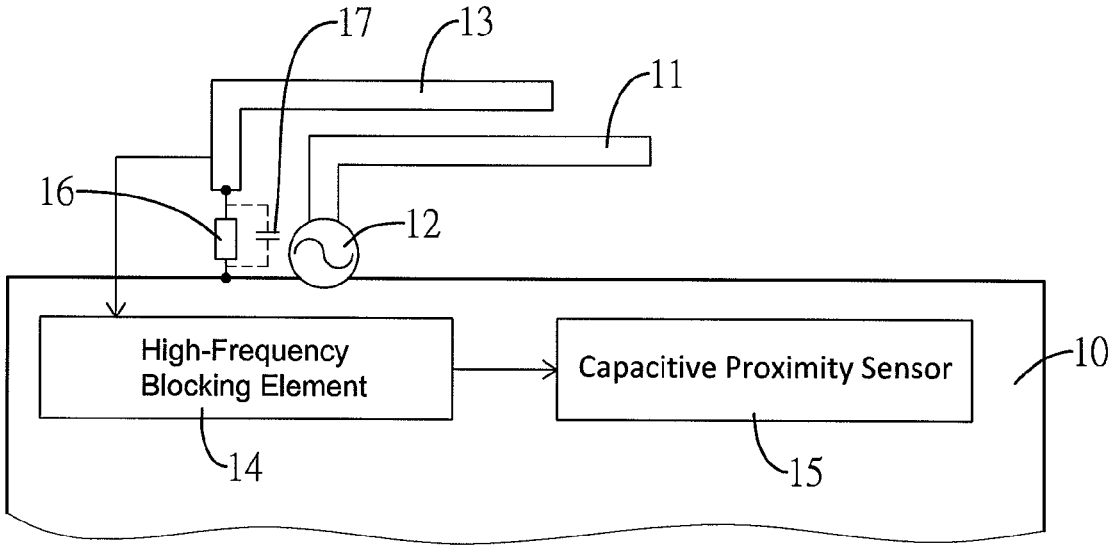
FIG. 1 is a schematic diagram showing configuration of a first preferred embodiment according to the present invention.

The antenna module with proximity sensing function of the present invention can be applied for all kinds of electronic devices, which perform wireless communication, such as tablet PC, smart phone and so on. Please refer to FIG. 1. A first preferred embodiment of the present invention mainly comprises a ground plane 10, an antenna 11, a signal feed-in element 12, a sensing element 13, a high-frequency blocking element 14, a capacitive proximity sensor 15 and an electrostatic protection element 16. The electrostatic protection element 16 can be further connected to a modulating capacitor 17 in parallel.

The antenna 11 is connected to the ground 12 through the signal feed-in element 12 for transmitting or receiving data. The sensing element 13 is connected to the capacitive proximity sensor 15 through the high-frequency blocking element 14. The electrostatic protection element 16 is connected between the sensing element 13 and the ground plane 10.

The circuit operation of the present invention can depend on different situations to be illustrated as the following. First, there is a sensing capacitance produced between the human body and the sensing element 13 when the human body approaches the sensing element 13. The magnitude of the capacitance signal of the sensing capacitance is decided by the distance between the human body and the sensing element 13, and the capacitance signal becomes larger as the distance becomes closer. Because the operation is performed in a lower frequency, the electrostatic protection element 16 is in a high impedance state and approximates an open circuit for effectively showing an isolation effect to prevent the capacitance signal from being led to the ground plane 10. Because the high-frequency blocking element 14 exhibits low impedance in low frequency operation to exhibit a short circuit, the produced capacitance signal can be transmitted to the capacitive proximity sensor 15 through the high-frequency blocking element 14 and then converted to a digital signal by the capacitive proximity sensor 15. The digital signal can be provided to a control circuit or a central processing unit (CPU) within the electronic device to modulate the output power of a RF amplifier for decreasing a specific absorption rate (SAR). The modulating capacitor 17 connected to the electrostatic protection element 16 in parallel can be provided for modulating a sensing distance between the human body and the sensing element 13.

Moreover, the electrostatic protection element 16 exhibits low impedance to approximate a short circuit when the antenna 11 is operated at high frequency to generate a resonance. And then, the high-frequency blocking element 14 exhibits high impedance to approximate an open circuit for preventing a high-frequency signal from entering the capacitive proximity sensor 15. The sensing element 13 is equivalently to a quarter-wavelength microstrip line. When the energy is fed into the signal feed-in element, the antenna 11 can be excited to have a resonance frequency and emits the energy of the electromagnetic wave. Because there is a gap kept between the antenna 11 and the sensing element 13, the energy of the electromagnetic wave can be coupled to the sensing element 13 through the gap to allow the sensing element 13 to excite a new resonance and realize a multi-band antenna.

When the interference of an instantaneous voltage and an instantaneous current over a normal operation voltage occur, such as transmitting the static electricity to the electronic device as the human body contacts the electronic, the electrostatic protection element 16 changes to extremely low impedance to provide a conducting path for the instantaneous current to allow the instantaneous current to pass through the electrostatic protection element 16 to be further led to the ground plane 10 so that the instantaneous current can quickly pass through the electrostatic protection element to be led to the ground to achieve the protection effect of preventing ESD shock. Therefore, the damage resulted from the abnormal instantaneous voltage/current can be avoided and the protection for preventing the ESD shock can be achieved. After the instantaneous voltage/current, the electrostatic protection element 16 will return to original impedance.

Figure 2:
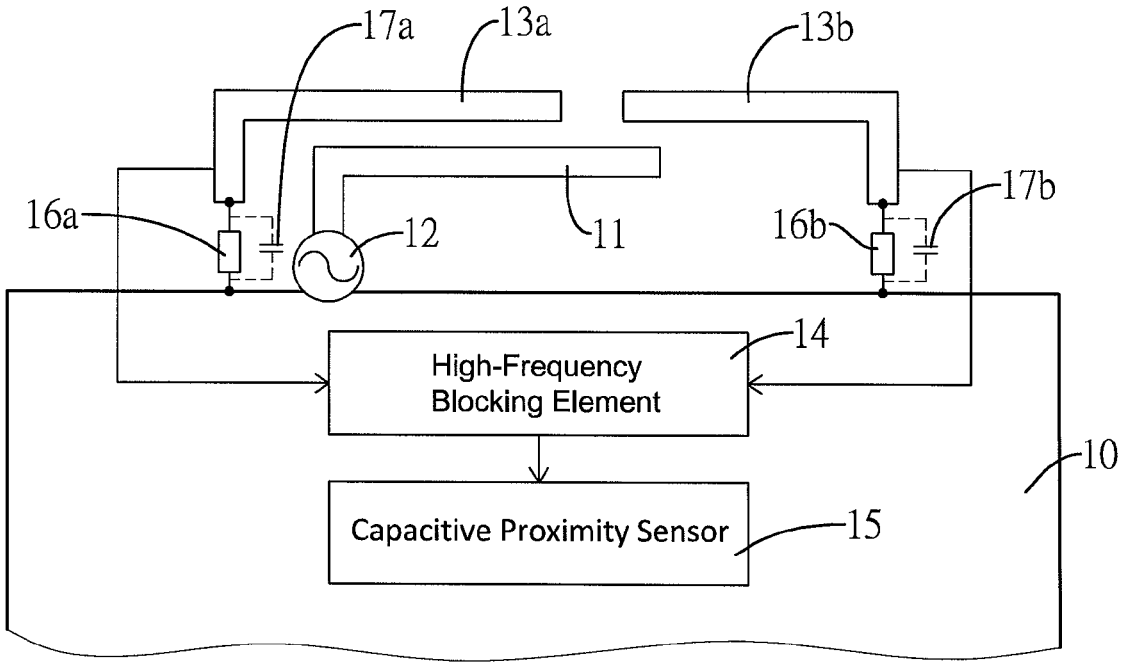
FIG. 2 is a schematic diagram showing configuration of a second preferred embodiment according to the present invention.

Please refer to FIG. 2, there are a plurality of sensing elements 13*a*, 13*b* and a plurality of electrostatic protection elements 16*a*, 16*b* in a second preferred embodiment of the present invention. Each of the sensing elements 13*a*, 13*b* is connected to the high-frequency blocking element 14 through corresponding electrostatic protection elements 16*a*, 16*b*. In addition to each function of the abovementioned circuit operation, the present embodiment can increase the sensing area by increasing the amount of the sensing elements 13*a*, 13*b*. A gap is kept between each of the sensing elements 13*a*, 13*b* and the antenna 11, therefore, the energy of the electromagnetic wave can be coupled to the sensing element 13 through such the gap to allow each sensing element 13 to excite a new resonance, respectively, for providing more resonance frequencies and realizing a multi-frequency resonance.

Figure 3:
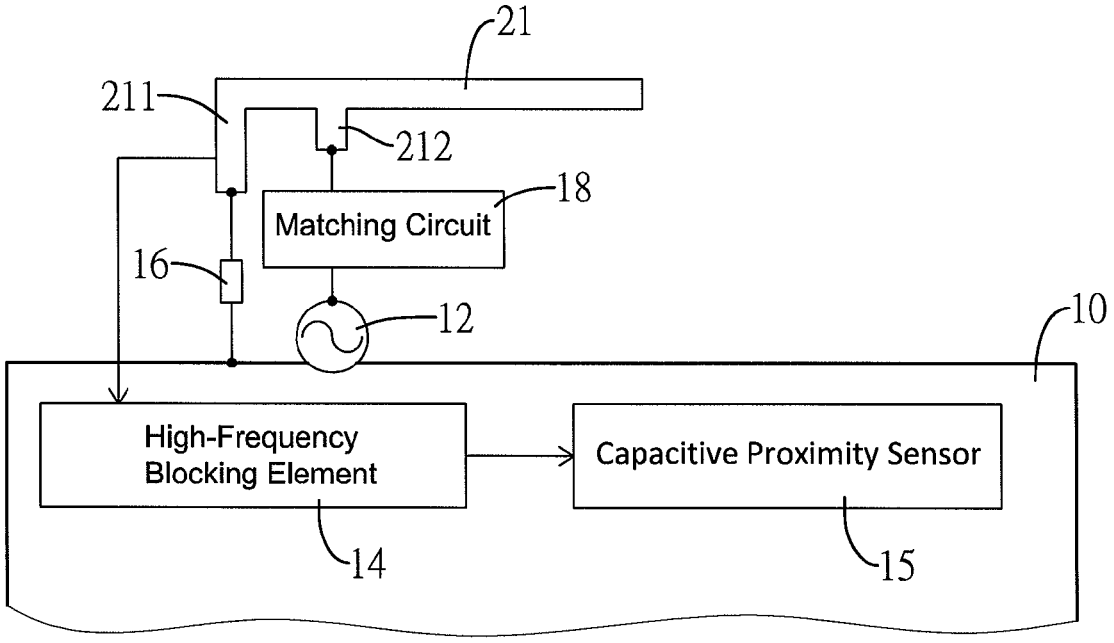
FIG. 3 is a schematic diagram showing configuration of a third preferred embodiment according to the present invention.

In each of the abovementioned embodiments, both the antenna 11 and the sensing element 13, 13*a*, 13*b* are independent coupling elements, however, it also can use a single element alone to have both functions of the antenna and the sensing element. For example, a third preferred embodiment as shown in FIG. 3 uses a single coupling element 21. The coupling element 21 is designed to be a planar inverted F antenna (PIFA) and has a first branch 211 and a second branch 212. The first branch 211 is connected to the ground plane 10 through the electrostatic protection element 16. The first branch 211 is also connected to the high-frequency blocking element 14 and further connected to the capacitive proximity sensor 15 through the high-frequency blocking element 14. The second branch 212 is connected to the signal feed-in element 12 through a matching circuit 18. When the operation is at high frequency, the electrostatic protection element 16 is high impedance and approximates an open circuit. At that time, the coupling element 21 is used as an antenna for transmitting and receiving data. On the contrary, the electrostatic protection element 16 exhibits high impedance to approximate an open circuit and the high-frequency blocking element 14 exhibits low impedance to approximate a short circuit at low frequency so that the coupling element 21 is used as a sensing element for sensing whether the human body approaches the electronic device thus to modulate SAR.

Figure 4:
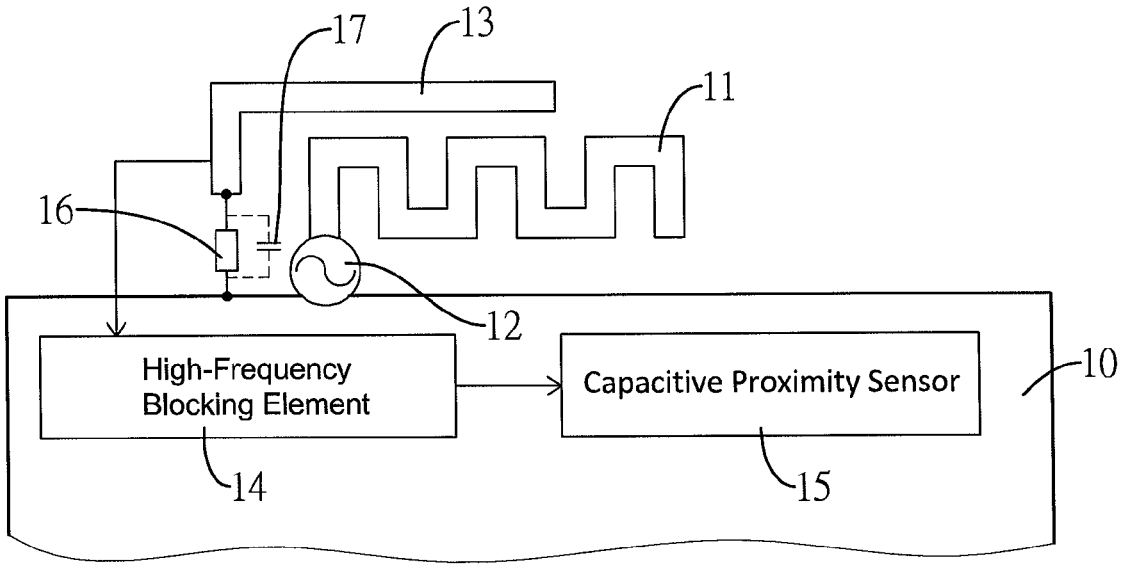
FIG. 4 is a schematic diagram of adopting a bended and extended antenna according to the present invention.
Figure 5:
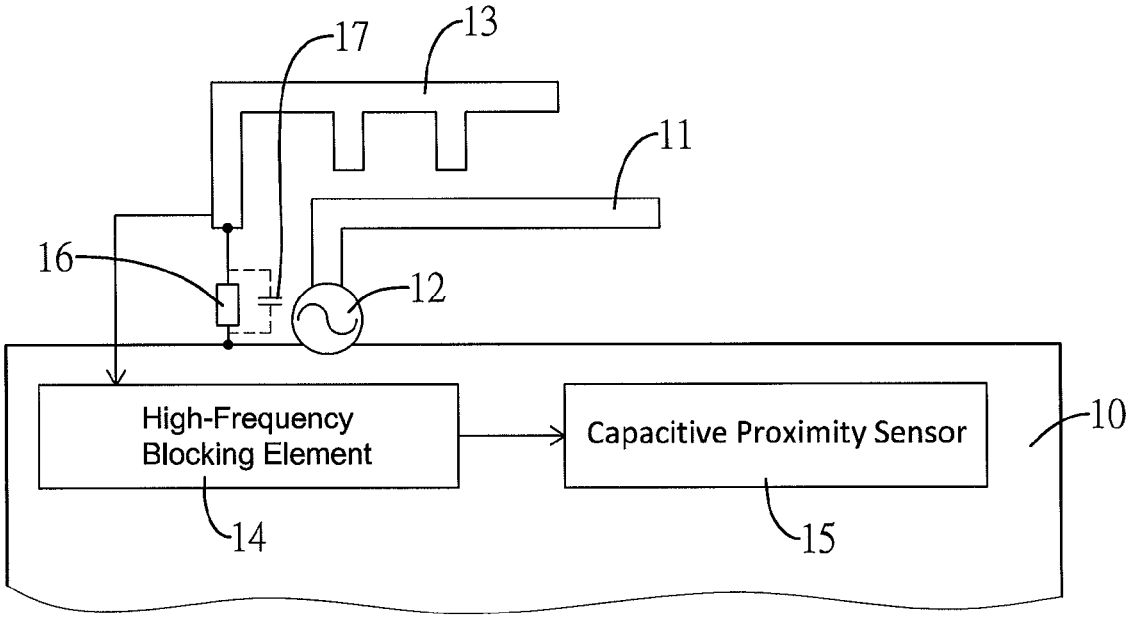
FIG. 5 is a schematic diagram showing a sensing element having a plurality of branches according to the present invention.

In each of the abovementioned embodiments, the ground plane 10 is a metal ground plane. The category of the adopted antenna 11 can be a monopole antenna, a dipole antenna, a planar inverted F antenna, a loop antenna, a slot antenna or an antenna capable of exciting a resonance. As shown in FIG. 4, the antenna itself can be provided with one or more than one branches, or bended and extended, for providing a multi-frequency or wide-frequency resonance. The sensing elements 13, 13*a*, 13*b* can be sheets and composed of metal or conductive material. Please refer to FIG. 5, the sensing element 13, 13*a*, 13*b* can have one or more than one branches, or be bended and extended, for providing a multi-frequency or wide-frequency resonance.

Figure 6:
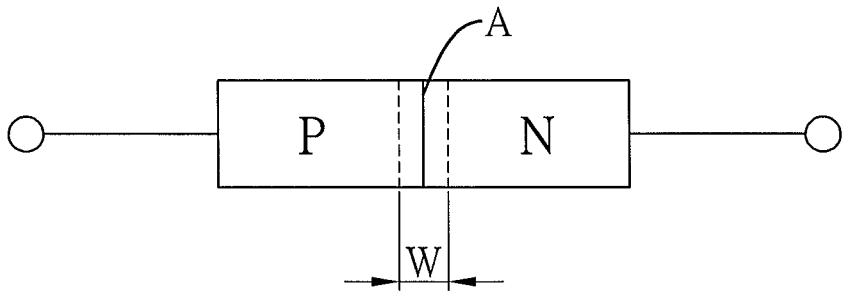
FIG. 6 is a schematic diagram showing a P-N junction of a diode.

With respect to the electrostatic protection element 16, 16*a*, 16*b* used in the present invention, the characteristic thereof is to exhibit low impedance at high frequency, exhibit high impedance at low frequency and further exhibit extremely low impedance when facing an instantaneous voltage or an instantaneous current, which is larger than the normal operation. The elements having the abovementioned characteristics comprise but not limit to a transient voltage suppression diode (TVS diode), a zener diode, a SAD, a diode array, a varistor and so on. For example, please refer to a junction of the diode sown in FIG. 6, a region between N-type conductor and P-type conductor is a depletion region. The junction of these two materials is equal to a parallel-plate capacitor and called "Junction Capacitance" (Cj) or called "Depletion Capacitance" (Cd). The width of the parallel plate is the width of the depletion region W, the dielectric between the parallel plate is conductive material $\epsilon_S$, the area of the parallel plate is an effective junction area A, and Cj can be defined by the following formulation:

$$C_j = \varepsilon_S \frac{A}{W}$$

$$Z_c = \frac{1}{2\pi f C_j}$$

Figure 7:
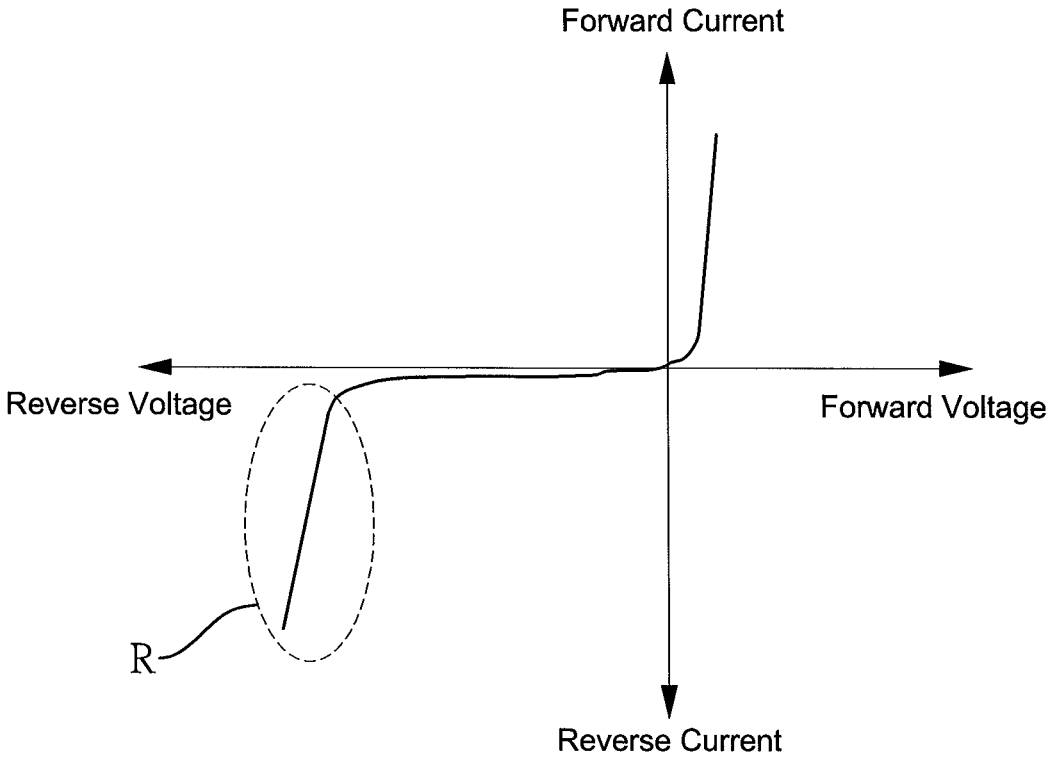
FIG. 7 is a schematic diagram showing a voltage-current characteristic curve of a diode.
Figure 8:
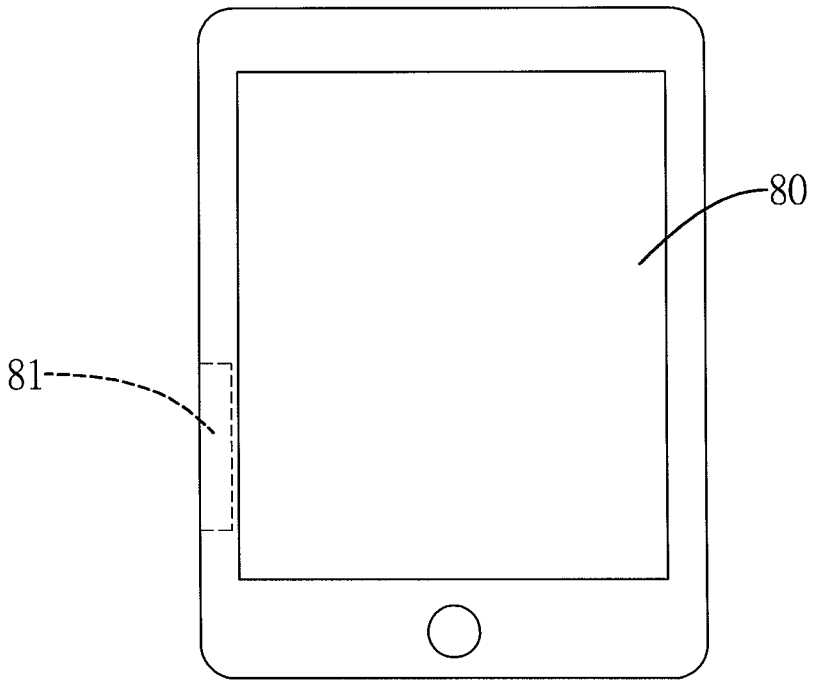
FIG.8 PRIOR ART
FIG. 8 is a schematic diagram showing configuration of disposing an antenna module inside a present table PC.
Figure 9:
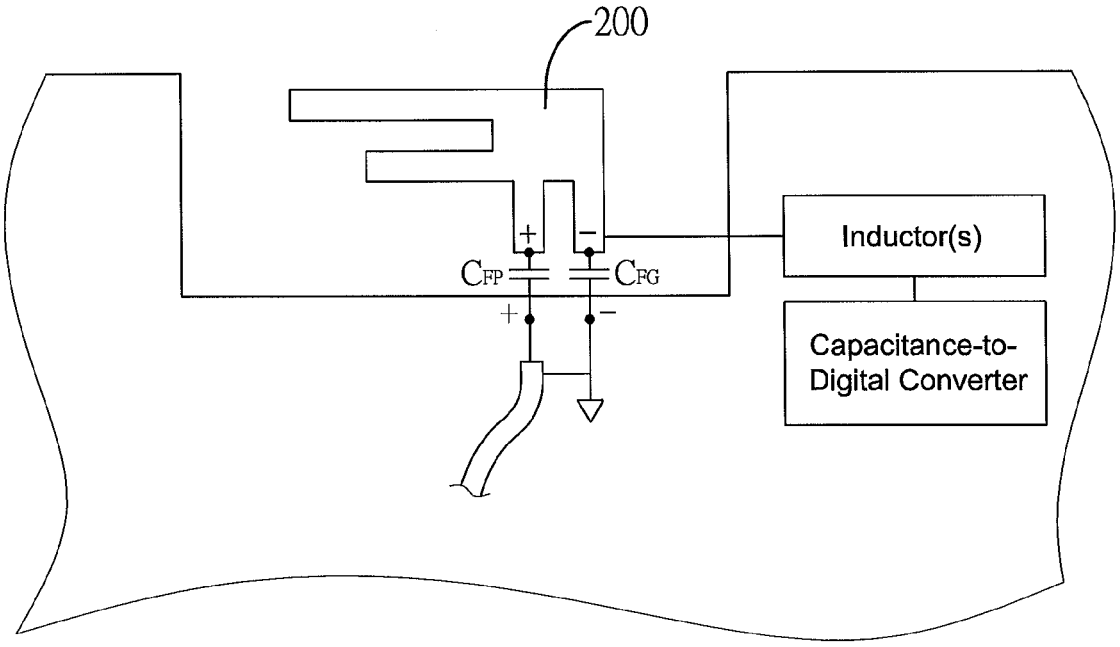
FIG.9 PRIOR ART
FIG. 9 is a schematic diagram showing configuration of an antenna module according to Taiwan patent publication No. 201240206 titled "antenna with integrated proximity sensor for proximity-based radio-frequency power control"
Figure 10:
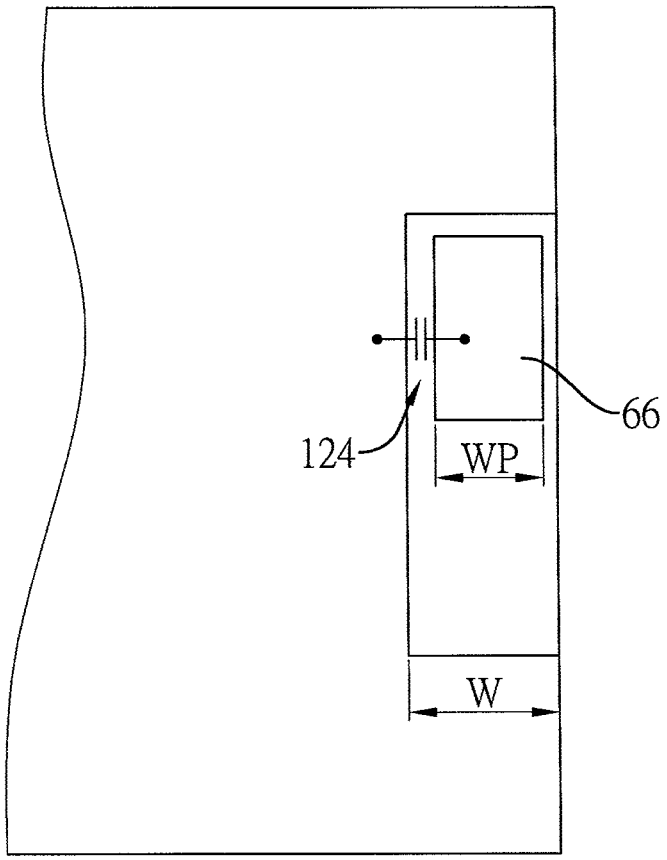
FIG.10 PRIOR ART
FIG. 10 is a schematic diagram showing configuration of an antenna module according to US patent publication No. 2011/0012793.

By the formulation, it is known that the impedance of the diode approximates a short circuit at high frequency and approximates an open circuit at low frequency. Please further refer to FIG. 7. Because the material of certain specific diodes has avalanche capability, the avalanche capability will occur when the instantaneous voltage exceeds the normal operation voltage of the circuit to have extremely low impedance as shown in zone R in FIG. 7. Therefore, a path with the extremely low impedance is provided the instantaneous current, and the diode will automatically return to the original impedance after finishing the instantaneous pulse so that it can be used as the electrostatic protection element 16 in the present invention.

The high-frequency blocking element 14 can be composed of inductive elements, such as a plurality of ferrite beads connected in series or a plurality of inductors connected in series, and the characteristic thereof exhibits low impedance at low frequency to approximate a short circuit and exhibits high impedance at high frequency to approximate an open circuit.

To sum up, the antenna with proximity sensing function of the present invention can not only maintain the function of transmitting and receiving data of the antenna but also can achieve the effect of preventing electrostatic discharge shock by combining the sensing element thereof with the electrostatic protection element. When sensing that the human body approaches the electronic device, the sensing element can produce a sensing capacitance signal for reducing the output power and the radiation electromagnetic wave of the antenna module to let the electronic device conform to the standard of SAR.

What is claimed is:

1. An antenna module with proximity sensing function adapted to be disposed inside an electronic device, the antenna module with proximity sensing function comprising:

a ground plane;

at least a sensing element having a first end being connected to a capacitive proximity sensor through a high-frequency blocking element, wherein the sensing element produces a capacitance signal to be transmitted to the capacitive proximity sensor through the high-frequency blocking element when sensing an approach of an object and has a second end as a free end; and an antenna being separated from the sensing element by a gap, connected to the ground plane through a signal feed-in element for wireless transmission and reception of data, and partially overlapped by the sensing element in a longitudinal direction parallel to an edge of the ground plane with the antenna positioned between the sensing element and the ground plane; and at least an electrostatic protection element connected between the first end of the sensing element and the ground plane, wherein the electrostatic protection element exhibits low impedance at high frequency, exhibits high impedance at low frequency and exhibits a conducting state when facing an abnormal instantaneous high voltage to allow the instantaneous high voltage to be transmitted to the ground plane.

2. The antenna module with proximity sensing function according to claim 1, wherein the electrostatic protection element is connected to a modulating capacitor in parallel.

3. The antenna module with proximity sensing function according to claim 1, wherein the high-frequency blocking element exhibits low impedance at low frequency and exhibits high impedance at high frequency.

4. The antenna module with proximity sensing function according to claim 1, wherein the high-frequency blocking element is an inductive element.

5. The antenna module with proximity sensing function according to claim 1, wherein there are a plurality of the sensing elements and a plurality of the electrostatic protection elements, each of the sensing elements is away from the antenna with a gap and each of the sensing elements is connected to the ground plane through a respective electrostatic protection element.

6. An antenna module with proximity sensing function provided for being disposed inside an electronic device, the antenna module with proximity sensing function comprising:

a ground plane;

a coupling element connected to the ground plane through a matching circuit and a signal feed-in element;

a high-frequency blocking element connected between the coupling element and a capacitive proximity sensor; and at least an electrostatic protection element connected between the coupling element and the ground plane, wherein the electrostatic protection element exhibits low impedance at high frequency, exhibits high impedance at low frequency and exhibits a conducting state when facing an abnormal instantaneous high voltage to allow the instantaneous high voltage to be transmitted to the ground plane, wherein the coupling element is used as an antenna for receiving and transmitting data in high-frequency operation and as a sensing element in low-frequency operation for producing a capacitance signal when sensing an approach of an object, and wherein the coupling element has:

a first branch connected to the ground plane through the electrostatic protection element and simultaneously connected to the high-frequency blocking element, wherein the electrostatic protection element is electrically and physically connected between the first branch of the coupling element and the ground plane; and a second branch connected to the ground plane through the matching circuit and the signal feed-in element.

7. The antenna module with proximity sensing function according to claim 6, wherein the electrostatic protection element is connected to a modulating capacitor in parallel.

8. The antenna module with proximity sensing function according to claim 6, wherein the high-frequency blocking element exhibits low impedance at low frequency and exhibits high impedance at high frequency.

9. The antenna module with proximity sensing function according to claim 6, wherein the high-frequency blocking element is an inductive element.

* * * * *